US012759039B2

(12) United States Patent
Enke

(10) Patent No.: US 12,759,039 B2
(45) Date of Patent: Oct. 13, 2026

(54) VENTING DEVICE, CASTING DEVICE WITH VENTING DEVICE, VACUUM DIE-CASTING SYSTEM AND METHOD FOR OPERATING THE VACUUM DIE-VCASTING SYSTEM

(71) Applicant: InterGuss Giessereiprodukte GmbH, Bad Windsheim (DE)

(72) Inventor: Christian Enke, Burgbernheim (DE)

(73) Assignee: InterGuss Giessereiprodukte GmbH, Bad Windsheim (DE)

( * ) Notice: Subject to any disclaimer, the term of this patent is extended or adjusted under 35 U.S.C. 154(b) by 95 days.

(21) Appl. No.: 18/800,453

(22) Filed: Aug. 12, 2024

(65) Prior Publication Data

US 2026/0027615 A1 Jan. 29, 2026

(30) Foreign Application Priority Data

Jul. 29, 2024 (DE) ..... 10 2024 121 519.4

(51) Int. Cl.
*B22D 45/00* (2006.01)
*B22D 18/00* (2006.01)
*B22D 18/06* (2006.01)

(52) U.S. Cl.
CPC ..... *B22D 45/005* (2013.01); *B22D 18/06* (2013.01)

(58) Field of Classification Search
CPC ..... B22D 45/005; B22D 18/00; B22D 18/06; B22D 17/145; B22D 45/00; B22D 17/14; B22D 17/32; B22C 9/067
See application file for complete search history.

(56) References Cited

FOREIGN PATENT DOCUMENTS

CN 201684909 U * 12/2010
CN 115301914 A * 11/2022 ..... B22D 17/145
(Continued)

OTHER PUBLICATIONS

English Machine Translation of CN201684909U (Year: 2010).*
English Machine Translation of CN115301914A (Year: 2022).*

*Primary Examiner* — Keith Walker
*Assistant Examiner* — Steven S Ha
(74) *Attorney, Agent, or Firm* — Dickinson Wright PLLC; Andrew D. Dorisio; Nicholas P. Coleman

(57) ABSTRACT

The invention relates to a venting device (01) for venting a casting chamber (11) by means of an evacuation device (12), wherein the venting device (01) has a base body (02) having an outflow channel (03) which is formed within the base body (02) and having an insertion portion (04) for being connected to the casting chamber (11) in a detachable and fluid-conducting manner and having a connection portion (05) for being connected to the evacuation device (12) in a detachable and fluid-conducting manner, wherein air can flow out through the outflow channel (03) when evacuating the casting chamber (11) and a filter unit (06) is disposed in the outflow channel (03). Furthermore, the invention relates to a casting device (10) comprising at least one casting chamber (11) having a casting chamber wall (13). Furthermore, the invention relates to a casting device (10) comprising at least one casting chamber (11) having a casting chamber wall (13), and to a vacuum-assisted pressure die casting system (100) having a casting device (10) and to a method for operating a vacuum-assisted pressure die casting system (100).

15 Claims, 5 Drawing Sheets

(56) References Cited

FOREIGN PATENT DOCUMENTS

| | | | |
|---|---|---|---|
| DE | 10022560 | A1 | 11/2001 |
| EP | 1832362 | A1 | 9/2007 |
| EP | 3593924 | A1 | 1/2020 |

* cited by examiner

VENTING DEVICE, CASTING DEVICE WITH VENTING DEVICE, VACUUM DIE-CASTING SYSTEM AND METHOD FOR OPERATING THE VACUUM DIE-VCASTING SYSTEM

TECHNICAL FIELD

The invention relates to a venting device for venting a casting chamber of a casting device, a casting device comprising the venting device, a vacuum-assisted pressure die casting system comprising the casting device and a method for operating the vacuum-assisted pressure die casting system.

BACKGROUND

During the production of metal components using the die casting method, metal melt is fed into a casting chamber. The necessary filling volume of the casting chamber is determined by the material volume of the component to be produced later. By moving a casting plunger in the casting chamber, the metal melt contained within can be pressed into a cavity of the tool. Die casting is a particularly economical method for the production of complicatedly shaped workpieces. However, it is problematic that the air contained in the casting chamber and in the cavity of the tool sometimes leads to air inclusions in the workpiece. This can manifest itself in defects in the workpiece as well as in the form of microbubbles inside the workpiece being formed. In particular, it is known that air inclusions inside the workpiece near the surface lead to particular problems. Due to the high pressure when filling the cavity, breakouts can occur on the surface during the subsequent removal process due to the expansion of the trapped air. Another known problem is that to increase the strength of the material during a subsequent temperature change profile, the trapped air bubbles can lead to further material damage. This leads in part to shape defects, surface defects and, in particular, to damage to the strength properties of the subsequent component. Due to the presence of air in the cavity of the pressure die casting tool when it is closed and the need to maintain a corresponding filling volume in the casting chamber and thus initially a volume of air, it is therefore essential to remove the trapped air before the metal melt is filled in. It is therefore important to avoid trapping air in the casting chamber.

In order to avoid air inclusions, vacuum-assisted pressure die casting systems are known from the state of the art, in which a melt is introduced by means of a plunger-operated casting chamber into a pressure die casting tool having a cavity by means of pressure, the gas contained within the pressure die casting tool being evacuated from the pressure die casting tool by means of an underpressure system at one end of the pressure die casting tool opposite the introduction of the melt. This prevents air inclusions in the pressure die casting tool and workpieces of particularly high quality can be produced. It is also known to evacuate the casting chamber by means of an underpressure system. In this case, the evacuation device is disposed at a rear section of the casting chamber. Another example of the vacuum process, by means of which air inclusions in the casting chamber are reduced, is carried out using an anvil as a counter element to the casting plunger in the casting chamber. In this respect, the air volume in the casting chamber can be reduced to a minimum when filling the casting chamber.

A disadvantage of the prior art, however, is that the suction of the air in the casting chamber leads to the fact that, in addition to the air to be evacuated, melt is also sucked in by the underpressure device, in particular after the melt has solidified, and this can block or close the suction hole. This is because if the melt solidifies in the suction hole and/or in a connecting line to the underpressure device, it becomes more difficult to use the casting chamber and the underpressure device again and/or the underpressure device is damaged, making extensive maintenance and repair work necessary before a new casting process.

SUMMARY

Therefore, there is a great need for a reliable and replaceable venting device for a casting device, so that a casting device having a casting chamber and the venting device according to the invention functions reliably and is reusable, and the undesired inclusion of gas in the melt, in particular air inclusions, can be effectively prevented for the production of high-quality workpieces and/or for quality assurance of the workpieces to be produced. At the same time, it should be possible to suction or evacuate the air in the casting chamber in a simple and reliable manner. The venting device and the casting device with casting chamber should also be inexpensive to manufacture and durable and economical to operate. It is therefore the object of the invention to provide a venting device and a casting device with a casting chamber in order to overcome the above-mentioned difficulties. This object is attained in a surprisingly simple but effective way by a venting device for venting a casting chamber by means of an evacuation device according to the teachings of independent claim 1, a casting device comprising at least one venting device according to claim 8, a vacuum-assisted pressure die casting system comprising at least one casting device according to claim 12 and a method for operating a vacuum-assisted pressure die casting system according to claim 13.

According to the invention, a venting device for venting a casting chamber by means of an evacuation device is proposed. For venting the casting chamber of a casting device, the venting device can be disposed between the casting chamber and the evacuation device of the casting device. The venting device has a base body having an outflow channel which is formed within the base body and through which air can flow out when evacuating the casting chamber. The outflow of air from the casting chamber can be assisted by the evacuation device, which can extract air from the casting chamber. In particular, due to the evacuation of the casting chamber by means of the evacuation device, in addition to the air contained within the casting chamber, the molten material introduced into the casting chamber, which is subsequently referred to as melt, can also at least partially enter the outflow channel of the venting device.

The basic idea of the invention is therefore to retain the melt that has entered the outflow channel in the venting device in a simple manner so that no damage to the evacuation device can occur. For this purpose, the base body of the venting device has an insertion portion for being connected to the casting chamber in a detachable and fluid-conducting manner and a connection portion for being connected to the evacuation device in a detachable and fluid-conducting manner, while a filter unit is disposed in the outflow channel. The outflow channel extends completely through a base body of the venting device, but can have different cross-sections. Furthermore, the base body and thus also the outflow channel is connected to the casting chamber in a fluid-conducting manner, in particular in such a manner that at least gas, but usually also unintendedly melt, can pass from the casting chamber into the outflow channel. The connection portion of the base body is used for connecting the base body and the outflow channel to an evacuation device in a detachable and fluid-conducting manner. The evacuation device can be designed as an underpressure system and/or vacuum pump. By means of the underpressure system and/or the vacuum pump, the air contained within the casting chamber before the melt is introduced can be reliably extracted. The evacuation device can be connected directly to the connection portion. In practice, however, it has proven to be advantageous if the evacuation device is indirectly connected to the connection portion of the venting device via a fluid-conducting, preferably gas-conducting line, for example via a tube. In the context of the invention, the term "fluid-conducting" refers to a gas- and/or liquid-conducting connection. The connection between the base body and the evacuation device can be direct, i.e., the evacuation device is directly adjacent to the base body, or indirect, i.e., a connecting means, for example a tube or a pipe, can be disposed between the evacuation device and the base body. In accordance with the basic idea of the invention, both the connection between the insertion portion of the base body and the casting chamber and the connection between the connection portion and the evacuation device are detachable, so that the venting device can be easily removed from the casting chamber and the evacuation device. This makes it easy to replace the entire venting device and/or the filter unit disposed in the outflow channel. Furthermore, the detachable connection allows the venting device to be quickly and easily separated from the casting chamber and the evacuation device for maintenance and inspection purposes.

According to the invention, the filter unit disposed in the outflow channel of the venting device is designed in such a way that melt that has entered the outflow channel is retained in the filter unit so that only air and no melt can be conducted from the outflow channel to the evacuation device. Accordingly, the filter unit serves to absorb any unwanted melt discharged from the casting chamber into the outflow channel in the direction of the evacuation device. This ensures reliable suction of air from the casting chamber, while at the same time protecting the evacuation device from contamination.

Advantageous embodiments of the invention are the subject matter of the dependent claims. In addition, all combinations of at least two features disclosed in the description, the claims and/or the figures fall within the scope of the invention. It is understood that the explanations made with respect to the venting device refer in an equivalent manner to the casting device according to the invention, to the vacuum-assisted pressure die casting system according to the invention and to the method according to the invention, without being mentioned separately. In particular, linguistically common rephrasing and/or an analogous replacement of respective terms within the scope of common linguistic practice, in particular the use of synonyms backed by the generally recognized linguistic literature, are of course comprised by the content of the disclosure at hand without every variation having to be expressly mentioned.

In a preferred embodiment of the invention, the base body can be tubular. Preferably, the base body can be tubular with a circular cross-section, i.e., rotationally symmetrical. In other words, the base body can be designed as a hollow cylinder. However, it is also conceivable that the base body has several hollow cylinders with different inner diameters and different outer diameters, wherein the inner diameter of the base body corresponds to the diameter of the outflow channel. Preferably, the base body is formed from two hollow cylinders with different inner diameters and different outer diameters. The tubular, preferably rotationally symmetrical design of the base body serves to conduct the air to be extracted from the casting chamber through the outflow channel with as little resistance as possible and serves to connect the casting chamber and the evacuation device in a simple manner, since a clamping or screw connection can be formed in a simple manner on an outer surface of a tube, in particular a hollow cylindrical tube.

The base body can have a step that is formed between the insertion portion and the connection portion of the base body. Preferably, the base body has a radially protruding diameter step which is formed between the insertion portion and the connection portion. Thus, the insertion portion can be formed with a smaller outer diameter than the connection portion. If the base body is tubular, the base body can be made of a hollow cylindrical tube with a smaller diameter in the area of the insertion portion and a hollow cylindrical tube with a larger diameter than the insertion portion in the area of the connection portion, so that a radially protruding diameter step is formed between the insertion portion and the connection portion. It is conceivable that the base body not only has a diameter step in relation to the outer diameter, but also in relation to the inner diameter, i.e., the diameter of the outflow channel. The outflow channel can also have a diameter step. Preferably, the outflow channel is designed with a larger diameter in the area of the connection portion and with a smaller diameter than the connection portion in the area of the insertion portion.

The insertion portion can have an external thread and/or the connection portion can have a clamping surface. A line, for example a tube, leading to the evacuation device can be clamped to the clamping surface of the connection portion in a simple manner by means of a clamping connection. Additionally or alternatively, it is conceivable that the connection portion has an external thread in order to be able to fasten a line to the evacuation device by means of a screw connection. The insertion portion of the base body can have an external thread that interacts with an internal thread of the casting chamber so that the venting device can be screwed into the casting chamber to be vented, preferably into its wall, in a simple manner. The external thread on the insertion portion preferably has a size of ⅜ inch to 1 inch. If the base body is a hollow cylinder, this results in an internal cross-sectional area of the outflow channel of 70 to 550 $mm^2$ in the area of the insertion portion. Such a cross-sectional area of the outflow channel enables the reliable and rapid removal of unwanted air from the casting chamber.

A transmission element for transmitting a torque to the base body in a torque-transmitting manner can be disposed on the base body. Preferably, the transmission element is disposed around the insertion portion on the base body. Additionally or alternatively, the transmission element can be disposed so as to surround the connection portion. The transmission element can be brought into contact with the step between the insertion portion and the connection portion. Preferably, the transmission element is designed as a multi-sided profile. The torque-transmitting connection between the transmission element and the base body means that an external force which acts on the transmission element and which can be applied to the transmission element using a tool, such as an open-end wrench, can be transmitted to the base body. The torque applied to the transmission element by the tool can thus be transferred to the base body, allowing it to be screwed into the wall of a casting chamber quickly, reliably and without great effort using the tool. In other words, the application of force to the transmission element results in a rotational movement of the base body, in particular the insertion portion of the base body. In principle, the transmission element can be connected to the base body in any manner, as long as torque transmission between the transmission element and the base body is guaranteed. It has proven to be advantageous if a transmission element and the base body are connected by means of a welded joint in a torque-transmitting manner. However, it is also conceivable that the transmission element is formed monolithically with the base body.

The filter unit can have an air-permeable filter material made of steel. The air-permeable filter material made of steel can advantageously retain the melt in the outflow channel and allow the air to pass through and also has a long service life. In the context of the invention, the term "service life" refers to the time the filter material can be used until it is saturated, i.e., until it is clogged with melt and no longer allows air to flow through as required or at all. In the context of the invention, it has been recognized that steel wool is unsuitable as a filter material because its flow resistance is too high. Furthermore, it has been recognized in the context of the invention that steel chips, steel fibers or steel wires are suitable as a filter material, as these have a lower flow resistance than steel wool. Particularly preferably, a filter material made of steel fibers can be used. The filter material can, for example, be designed as a sponge made of steel fibers, comparable to known pot cleaners. Once the filter material is saturated, the venting device can be separated from the evacuation device and/or the casting chamber and the filter unit can be replaced. It is also conceivable that the venting device as a whole can be exchanged and replaced by a new venting device. This is particularly possible with low expenditure and in an economical manner, as the compact design of the venting device according to the invention allows a cost-effective production and easy handling.

For easy insertion of the venting device into a casting chamber wall, the insertion portion of the base body can have a recess. The recess can preferably be formed circumferentially on the outer surface. The recess has a recess depth and an axial extension, the axial extension of the recess being the extension of the recess in the axial direction relative to the longitudinal axis of the base body. The axial extension of the recess can correspond at least to the depth of the insertion of the venting device into the casting chamber wall minus the axial extension of the external thread at the insertion portion. In other words, if the venting device is connected to the casting chamber, the recess extends at least as far as the outer wall surface of the casting chamber wall, preferably at least slightly beyond. The recess on the insertion portion can thus ensure easy insertion of the venting device into the casting chamber. The recess is disposed downstream of the external thread in the axial direction. The recess is thus formed between the end of the insertion portion, which can be inserted into the vent hole, and the connection portion. The casting chamber recess can extend in the evacuation direction, i.e., in the axial direction of the vent hole. Preferably, the recess of the vent hole is formed between the external thread of the insertion portion and the transmission element.

In a further aspect, the invention relates to a casting device comprising at least one casting chamber having a casting chamber wall, wherein the venting device according to the invention is detachably connectable to the casting chamber. At a first end, the casting chamber may have a filling hole, preferably extending through the wall of the casting chamber, wherein the casting chamber may have a discharge hole for discharging the melt from the casting chamber at a second end opposite the first end, preferably at the end face. The casting chamber is used to receive the melt to be introduced into a pressure die casting tool. The melt can be introduced into the casting chamber via the filling hole. The casting chamber can be essentially cylindrical in shape, although any hollow extrusion body shape is conceivable. In order to be able to introduce the melt received from the casting chamber into the pressure die casting tool by means of pressure, the casting device can further comprise a plunger. The plunger can be movable from a first end of the casting chamber to a second end of the casting chamber. The first end and the second end of the casting chamber close off the casting chamber in the extrusion direction, i.e., at the front. For this purpose, the circumferential geometry of the plunger can be adapted to the interior of the casting chamber and can apply the necessary pressure to the melt in order to press it through the discharge hole disposed at the second end.

Before the melt is poured in, the casting chamber is filled with a gas, usually air. This gas should be removed, preferably completely, from the casting chamber before and/or while the melt is introduced into the casting tool by means of pressure. To discharge the air from the casting chamber of the casting device, the casting chamber wall is penetrated by a vent hole in the casting chamber. The venting device according to the invention can be inserted into this vent hole and can be detachably connected to the casting chamber. The venting device according to the invention can be inserted at least partially into the vent hole of the casting chamber wall. Preferably, the insertion portion is at least partially insertable into the casting chamber wall.

The invention makes it possible to provide a casting device that is durable while also effectively preventing inclusions in the melt as soon as during the pouring of the melt into the casting chamber and when discharging the melt from the casting chamber, thus significantly improving the quality of the cast parts to be produced. Furthermore, the casting device can also be operated effectively with a higher throughput and lower maintenance times, as the venting device is detachable and thus connected to the casting chamber so as to be easily replaceable.

An internal thread for screwing in the venting device can be disposed in the vent hole. The internal thread of the vent hole can cooperate with the external thread of the insertion portion of the venting device in order to fasten the venting device within the casting chamber wall. Alternatively and/or additionally, a stop, against which the insertion portion of the venting device can be brought into contact, can be formed in the vent hole. The stop advantageously limits the depth of the insertion of the venting device into the casting chamber wall and can therefore define a required insertion depth. In relation to the radius of the preferably cylindrical vent hole, the stop can be designed as a projection projecting radially inwards, so that the vent hole in the area of the stop has a smaller diameter than the vent hole in its further course. The diameter in the area of the stop can correspond to the diameter of the outflow channel of the venting device. Preferably, at least one surface of the step is formed by and/or aligned with the inner wall surface of the casting chamber. In other words, the stop can be formed as a part of the inner wall surface of the casting chamber. The vent hole with a stop can be formed, for example, by combining two holes, namely a blind hole with a larger bore diameter and a through hole with a smaller bore diameter, the bore axes being formed to coincide. The stop can have a thickness of between a minimum of 1 mm and a maximum of 25 mm.

Preferably, the stop can have a thickness of 3 mm to 10 mm. Most preferably, the stop has a thickness of 5 mm. Within the scope of the invention, the thickness of the stop is measured in the evacuation direction. The stop can be formed integrally with the casting chamber wall, the casting chamber wall being formed in the thickness of the stop in the area of the stop.

In the context of the invention, it has been recognized that a gap can occur between the stop and the venting device when the venting device is fastened to the casting chamber wall. In particular, it has been recognized as disadvantageous if the melt reaches the area of the screw connection between the casting chamber wall and the venting device and thus makes the screw connection largely undetachable. Therefore, according to a preferred embodiment of the invention, the gap is impermeable to metal. This means that the gap is so small and/or is sealed with sealing means in such a manner that no metallic melt can penetrate into the gap and/or escape from the casting chamber via the gap.

The vent hole inserted into the casting chamber wall can subsequently have a casting chamber recess in the evacuation direction of the detachable connection between the venting device and the casting chamber. Thus, for easy insertion and fastening of the venting device in the casting chamber wall of the casting chamber, either the venting device can have a recess at the insertion portion or the vent hole of the casting chamber can have a recess. The casting chamber recess can be circumferential around the inner circumference of the vent hole. The casting chamber recess is disposed axially downstream of the detachable connection between the venting device and the casting chamber. The casting chamber recess is thus formed between the end of the insertion portion, which can be inserted into the vent hole, and the connection portion. The casting chamber recess extends in the evacuation direction, i.e., in the axial direction of the vent hole. Preferably, the casting chamber recess of the vent hole is formed between the internal thread of the vent hole and the outer casting chamber wall at which the vent hole ends. If the recess is formed circumferentially around the inner circumference of the vent hole, the vent hole can have two portions with different diameters, with the jump in diameter of a first step being formed at the transition from the internal thread to the casting chamber recess. A second diameter jump in the form of a step can be formed if a stop is formed in the vent hole. In this case, a second diameter jump is also formed at the transition from the stop to the internal thread. If a stop, a casting chamber recess and an internal thread are formed in the vent hole, the vent hole consequently has two steps and thus three different diameters. Preferably, the casting chamber recess is disposed downstream of the internal thread in such a manner that the casting chamber recess is directly connected to the internal thread. Alternatively or additionally, the internal thread can be directly connected to the stop in the evacuation direction.

In a further aspect, the invention relates to a vacuum-assisted pressure die casting system comprising at least one casting device (described elsewhere), the melt being conveyable into the casting chamber via the filling hole of the casting chamber and being supplyable to the vacuum-assisted pressure die casting system via the discharge hole of a cavity of a pressure die casting tool. The casting chamber therefore has a filling volume, the casting chamber being closable on one side by means of a casting plunger. For this purpose, metal melt is supplied to the casting chamber of the vacuum-assisted pressure die casting system. The melt can be conveyed from the casting chamber into a cavity of a pressure die casting tool by means of a movement of the casting plunger. By means of the evacuation device, preferably an underpressure system and/or a vacuum pump, a lower pressure compared to the atmosphere can be generated within the casting chamber and/or the cavity of the pressure die casting tool. Thus, an evacuation device can be used to remove unwanted air from the casting chamber and/or to remove unwanted air from the cavity of the pressure die casting tool in order to ensure the highest possible quality of the casting to be produced. In order to protect the evacuation device from contamination, in particular from contamination by the melt, the venting device according to the invention is disposed in the vent hole of the casting chamber. This reliably prevents the melt from passing from the casting chamber into the evacuation device, as the filter unit of the venting device retains the melt. In addition, the vacuum-assisted pressure die casting system can be operated effectively and economically with the venting device according to the invention, since the venting device can be dismantled, inspected, maintained and/or replaced quickly and with little effort due to its compact design. If the pressure die casting tool is also connected to a further evacuation device, for example a further underpressure system, a venting device according to the invention can also be disposed between the pressure die casting tool and the further evacuation device to protect the further evacuation device.

As the casting chamber is generally horizontal, it has proven advantageous to draw the air from the casting chamber upwards, meaning that the evacuation direction preferably runs from bottom to top in a vertical direction. In contrast, the melt is conveyed in a horizontal direction within the casting chamber, preferably by means of a plunger. If the vacuum-assisted pressure die casting system comprises two or more evacuation devices, which can be designed as an underpressure system and/or as a vacuum pump, the respective suctioning and/or evacuation processes at the pressure die casting tool and at the casting chamber can be easily coupled. It is also conceivable that the vacuum-assisted pressure die casting system comprises a plurality of pressure die casting tools, the pressure die casting tools particularly preferably having different cavities for the production of different components. The advantages of the casting device and the venting device described elsewhere can be achieved by means of the vacuum-assisted pressure die casting system.

The invention further proposes a method for operating the vacuum-assisted pressure die casting system described above, the method comprising the following steps:

a. Providing a casting device according to the invention; and
b. Introducing a melt through the filling hole into the casting chamber; and
c. Evacuating a gas contained within the casting chamber via the vent hole and the outflow channel of the venting device;
d. Conveying the melt via the discharge hole of the casting chamber into a pressure die casting tool.

Evacuating the gas contained within the casting chamber, usually air, via the vent hole and the outflow channel of the venting device, which is preferably connected to an evacuation device, prevents gas inclusions from forming in the melt. In addition, contamination of or damage to the evacuation device is prevented by retaining melt entering the outflow channel in the filter unit of the venting device. The evacuation of the gas contained within the casting chamber also helps to prevent gas inclusions in the pressure die casting tool and thus in the component to be produced. It is conceivable that the cavity of the pressure die casting tool is also evacuated. Steps a. to d. are preferably carried out consecutively, at least steps b. to d. also being able to be carried out simultaneously and/or at least overlapping in time. In other words, this means that during the filling in of the melt and the evacuation of the gas contained within the casting chamber, melt can already be conveyed into a pressure die casting tool via the discharge hole of the casting chamber.

In a further development of the method, step a. may comprise an inspection to determine the degree of saturation of the filter unit of the venting device. According to this further development of the invention, the filter unit can be inspected before the melt is introduced into the casting chamber through the introduction opening. Depending on the degree of saturation of the filter unit, the parameters for introducing the melt, for evacuating the casting chamber or for conveying the melt can be adjusted. For example, if the degree of saturation is increased, the gas contained within the casting chamber can be evacuated via the vent hole and the outflow channel of the venting device with increased pressure applied by the evacuation device.

Furthermore, it is conceivable that the venting device and/or the filter unit are replaced at regular intervals and/or depending on the degree of saturation of the filter unit. The venting device and/or the filter unit can be replaced depending on the degree of saturation detected during the inspection. This means that if the filter unit is clogged with melt to such an extent that no further evacuation of the gas contained within the casting chamber can take place, the filter unit and/or the entire venting device can be replaced. The venting device and/or the filter unit can be replaced at regular intervals, particularly in the case of a series production or the production of a large number of similar components with a similar or identical composition of melt. It is also conceivable that the regular replacement takes place depending on the throughput of melt through the casting device and thus depending on the amount of melt processed in the casting device. The venting device and/or the filter unit can also be replaced due to a drop in performance of the evacuation device. This is because a drop in the performance of the evacuation device can also be an indication of saturation of the filter material of the filter unit. In the context of the invention, it has proven to be advantageous, particularly with regard to economic aspects, if the entire venting device is preferably replaced when the filter unit is saturated. This can be done quickly and with little effort due to the compact design and low-cost production of the venting device according to the invention.

Within the scope of the invention, it is conceivable that the method comprises further steps than those explicitly shown, as described elsewhere. It is also conceivable that individual or all steps can be repeated as often as desired, and it is also conceivable that the method can be partially or fully automated.

BRIEF DESCRIPTION OF THE DRAWINGS

Further details, features and advantages of the invention are apparent from the following description of preferred embodiments in connection with the dependent claims. The respective features can be realized individually or in combination with each other. The invention is not limited to the embodiment. The embodiment is schematically illustrated in the figures. Identical reference signs in the individual figures designate similar elements, elements of similar functions or elements corresponding in terms of functionality.

DETAILED DESCRIPTION

Figure 1:
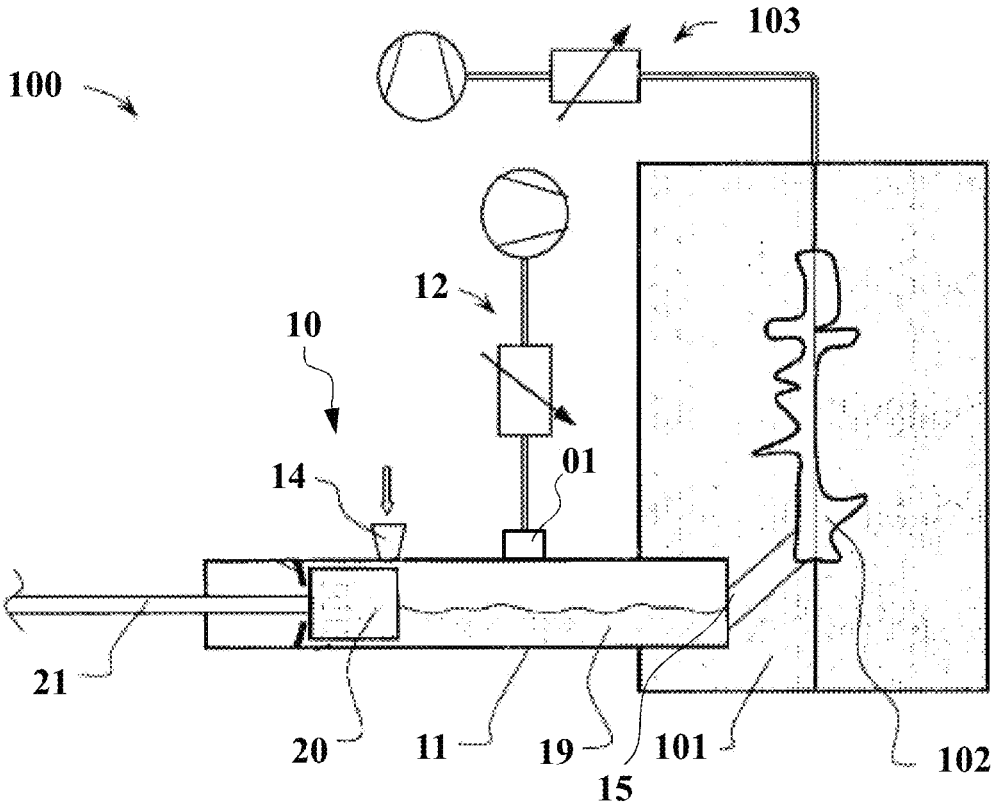
FIG. 1 shows a schematic diagram of a vacuum-assisted pressure die casting system having a casting device and a venting device according to the invention.
Figure 2:
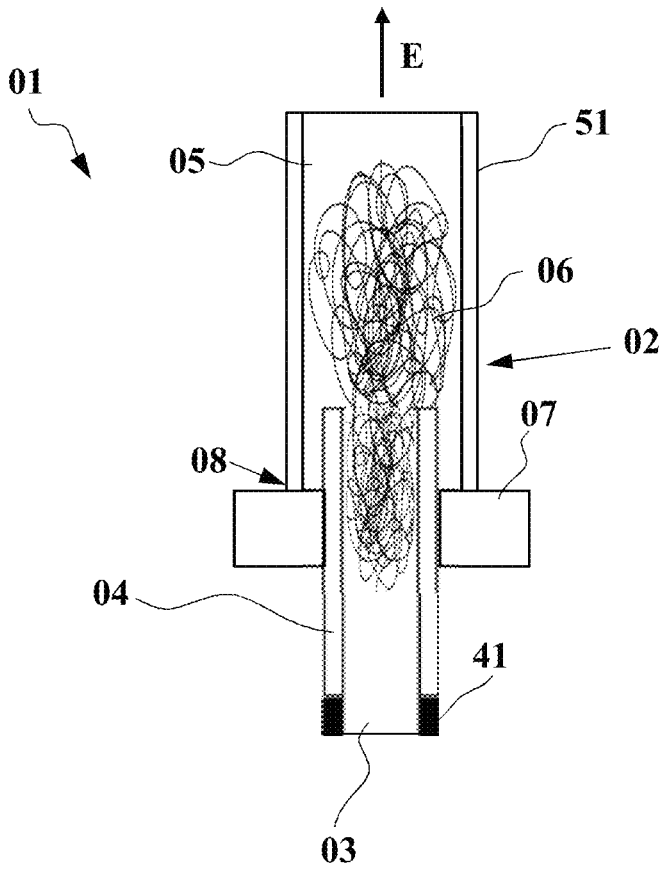
FIG. 2 shows a sectional view through a first embodiment of a venting device according to the invention.

FIG. 1 shows a schematic diagram of an example of a vacuum-assisted pressure die casting system 100 having a pressure die casting tool 101. This vacuum-assisted pressure die casting system comprises a casting device 10 having a casting chamber 11. Venting device 01 is disposed on casting chamber wall 13. For evacuating the air contained within casting chamber 11, venting device 01 is connected to first evacuation device 12, which is associated with casting chamber 11. A melt, preferably a metal melt 19, can be filled into casting chamber 11 via filling hole 14. How metal melt 19 enters casting chamber 11 is irrelevant with regard to the object of the invention. Furthermore, the necessary pressure for introducing metal melt 19 into pressure die casting tool 101 can be applied via casting plunger 20 and plunger rod 21. Pressure die casting tool 101 accordingly comprises cavity 102, which corresponds to the corresponding shape of the component to be manufactured. Again, it is irrelevant how the connection between casting chamber 11 and pressure die casting tool 101 or cavity 102 is designed, provided that the melt can be discharged from the casting chamber into cavity 102 of pressure die casting tool 101 via discharge hole 15 of the casting chamber.

A second evacuation device 103 is connected to cavity 102 to evacuate the gas contained within cavity 102. In this respect, evacuation devices 12 and 103 can be used to generate a negative pressure in casting chamber 11 and in pressure die casting tool 101 or cavity 102. It is obvious that one evacuation device can also be sufficient to remove unwanted air from the volume to be emptied from casting chamber 11 and cavity 102.

The exemplary embodiments of the venting device according to the invention and the interaction of venting device 01 with a casting chamber 11 and a casting device 10 according to the invention are shown in FIGS. 2 to 5.

As can be seen from FIGS. 2 to 5, venting device 01 has a base body 02 with an outflow channel 03 which is formed within base body 02 and through which air can flow out when casting chamber 11 is evacuated. Base body 02 has an insertion portion 04 and a connection portion 05, wherein a transmission element 07 formed in the manner of a multi-sided profile is disposed on insertion portion 04 and adjacent to connection portion 05. It can also be seen that insertion portion 04 is inserted into casting chamber wall 13 of casting chamber 11. At the end of insertion portion 04 inserted into vent hole 16 of casting chamber 11, an external thread 41 is formed, which interacts with an internal thread 161 of casting chamber wall 13 formed in a vent hole 16 to fasten venting device 01 to casting chamber 11. The depth of the insertion or the depth of screwing venting device 01 into casting chamber wall 13 is limited by stop 162. Stop 162 is designed as part of inner casting chamber wall 131 and has a thickness S in evacuation direction E. It can also be seen from FIGS. 2 to 5 that the base body is designed as a hollow cylindrical tube both in the area of insertion portion 04 and in the area of connection portion 05. Insertion portion 04 has a smaller inner diameter and a smaller outer diameter than connection portion 05. This results in a step 08 at the transition between connection portion 05 and insertion portion 04, transmission element 07 being able to come into contact against said step 08. Filter unit 06, which comprises a filter material in the form of steel chips, is disposed both inside insertion portion 04 and inside connection portion 05 of venting device 01. When the gas contained within casting chamber 11 of casting device 10 is evacuated, the gas thus flows through filter unit 06 in evacuation direction E, whereby entrained melt is retained in filter unit 06. Connection portion 05 has a clamping surface 51 on its outer surface, to which a connecting tube to evacuation device 12 can be clamped. Thus, both the connection between venting device 01 and evacuation device 12 and the connection between venting device 01 and casting chamber 11 of casting device 10 are designed to be detachable, so that venting device 01 can be easily removed or replaced.

Figure 3:
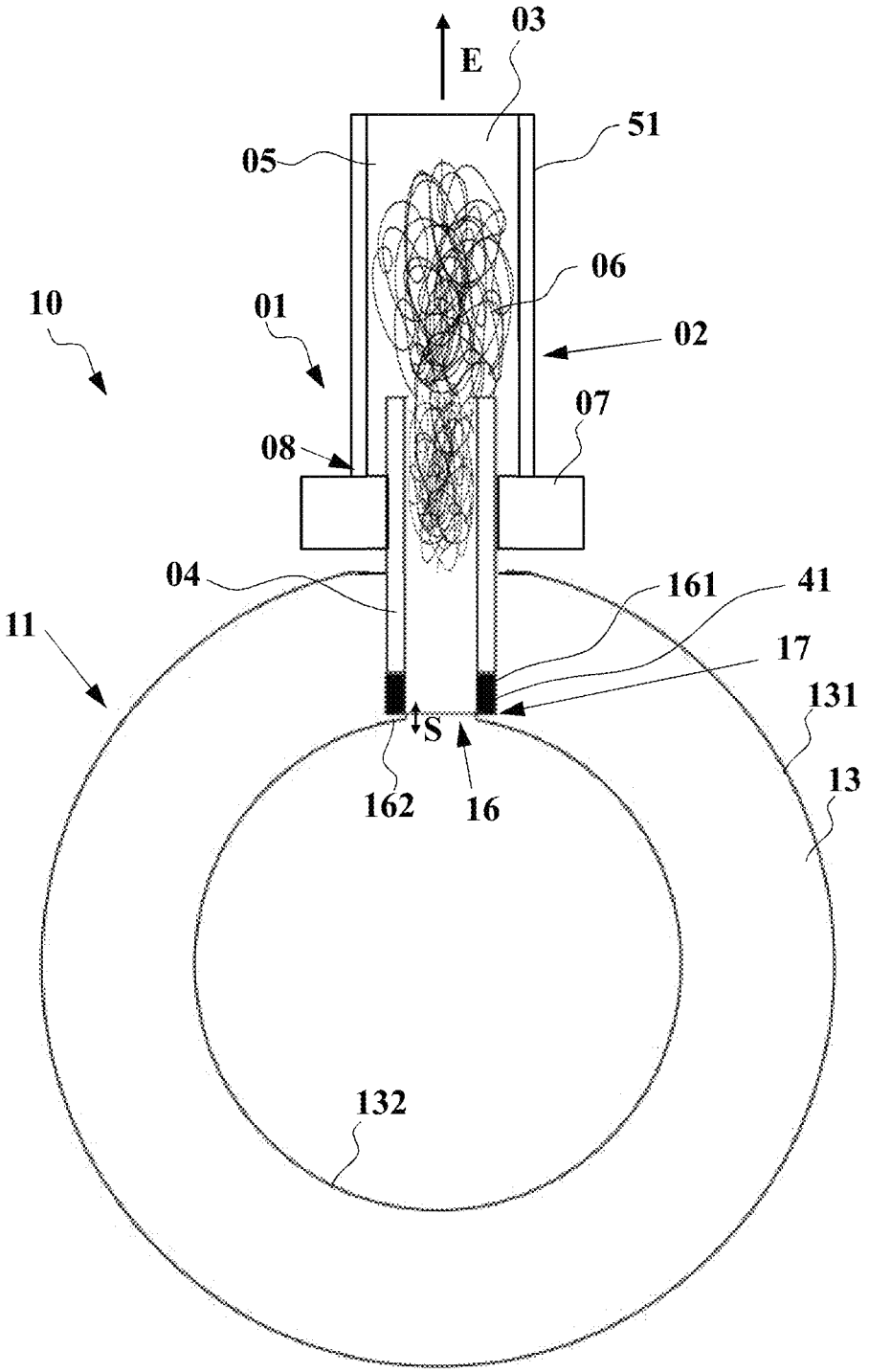
FIG. 3 shows a sectional view through the first embodiment of a venting device according to the invention mounted on the casting chamber of a casting device according to the invention.
Figure 4:
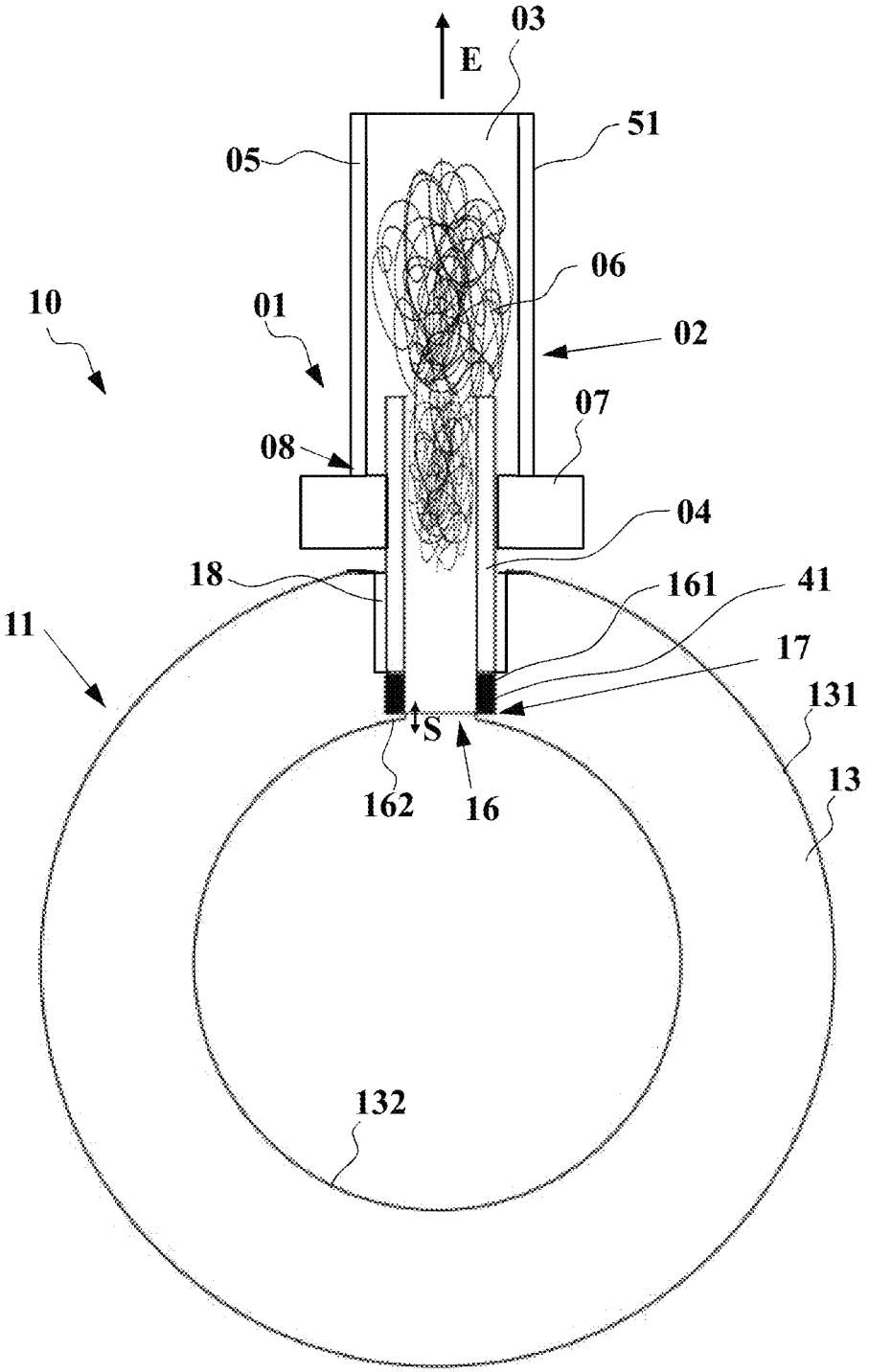
FIG. 4 shows the venting device according to the invention as shown in FIG. 3 with a second embodiment of a casting chamber of a casting device according to the invention.

The embodiment of a casting device 10 according to the invention shown in FIG. 4 differs from casting device 10 previously described in FIG. 3 only in that a casting chamber recess 18 is introduced into casting chamber wall 13 in the area of vent hole 16. Casting chamber recess 18 simplifies the insertion of venting device 01 into vent hole 16 as well as the positioning and screwing within vent hole 16. As can be seen from the illustration shown in FIG. 4, casting chamber recess 18 is inserted circumferentially into the inner circumference of vent hole 16 and extends in the axial direction, which coincides with evacuation direction E, from internal thread 161 to the outer wall surface of casting chamber 11.

Figure 5:
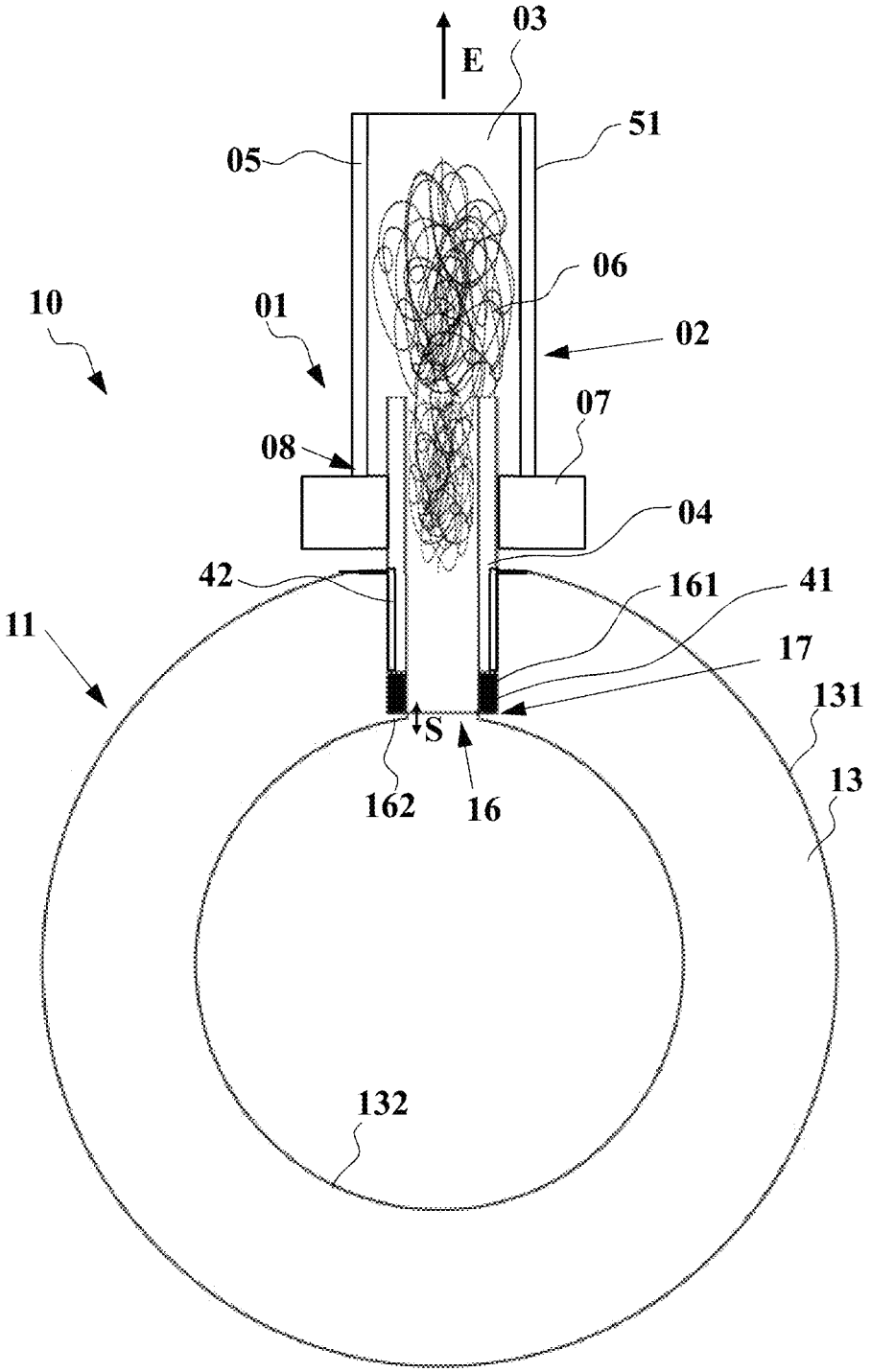
FIG. 5 shows a second embodiment of a venting device according to the invention having a casting chamber of a casting device according to the first embodiment.

Casting device 10 shown in FIG. 5 differs from casting device 10 shown in FIG. 3 only in that a recess 42 is provided in insertion portion 04. Recess 42 can be provided alternatively or additionally to casting chamber recess 18 shown in FIG. 4 and, as already explained with regard to casting chamber recess 18, facilitates the insertion and fastening of venting device 01 within vent hole 16 of casting chamber 11. As can be seen from the illustration shown in FIG. 5, recess 42 is disposed circumferentially in insertion portion 04. Furthermore, recess 42 is disposed adjacent to external thread 41 in the axial direction, which coincides with evacuation direction E when venting device 01 is mounted on casting chamber 11, and extends at least to outer casting chamber wall 132 of casting chamber 11 when venting device 01 is mounted on the casting chamber. In other words, the depth of the insertion of venting device 01 into casting chamber wall 13 corresponds to the axial extension of external thread 41 and recess 42.

The invention claimed is:

1. A venting device (01) for venting a casting chamber (11) by an evacuation device (12), wherein the venting device (01) has a base body (02) having an outflow channel (03) formed within the base body (02) and through which air flows out when evacuating the casting chamber (11), wherein the base body (02) has an insertion portion (04) for being directly connected to the casting chamber (11) in a detachable and fluid-conducting manner and a connection portion (05) for being connected to the evacuation device (12) in a detachable and fluid-conducting manner, and the base body (02) has a step (08), wherein the step (08) is formed between the connection portion (05) and the insertion portion (04) by the insertion portion (04) having a smaller outer diameter than the connection portion (05), and wherein the insertion portion (04) is directly connected to the connection portion (05), wherein a filter unit (06) is disposed in the outflow channel (03) of the base body (02).

2. The venting device according to claim 1, wherein the base body (02) is tubular.

3. The venting device according to claim 1, wherein the insertion portion (04) has an external thread (41) or the connection portion (05) has a clamping surface (51).

4. The venting device according to claim 1, wherein a transmission element (07) for transmitting a torque is disposed on the base body (02) in a torque-transmitting manner.

5. The venting device of claim 4, wherein the transmission element (07) at least partially forms the step (08) between the connection portion (05) and the insertion portion (04).

6. The venting device according to claim 1, wherein the filter unit (06) has a filter material which is permeable to air and made of steel.

7. The venting device according to claim 1, wherein the insertion portion (04) has a recess (42).

8. A casting device (10) comprising at least one casting chamber (11) having a casting chamber wall (13), wherein the casting chamber (11) has at least one filling hole (14) for introducing a melt into the casting chamber (11), at least one discharge hole (15) for discharging the melt from the casting chamber (11) and at least one vent hole (16), and further comprising a venting device (01) according to claim 1 inserted in the vent hole (16) and detachably connected to the casting chamber (11).

9. The casting device according to claim 8, wherein an internal thread (161) for screwing in the venting device (01) or a stop (162) which is brought into contact with the insertion portion (04) of the venting device (01) is formed in the vent hole (16).

10. The casting device according to claim 9, wherein a gap (17) between the stop (162) and the venting device (01) is impermeable to metal.

11. The casting device according to claim 8, wherein the vent hole (16) has a casting chamber recess (18) in the evacuation direction (A) of the detachable connection between the venting device (01) and the casting chamber (11).

12. A vacuum-assisted pressure die casting system (100) having a casting device (10) according to claim 8, wherein the melt is conveyable into the casting chamber (11) via the filling hole (14) and is suppliable to the vacuum-assisted pressure die casting system (100) via the discharge hole (15) of a cavity of a pressure die casting tool (101).

13. A method for operating a vacuum-assisted pressure die casting system (100) according to claim 12 comprising the following steps:

Introducing a melt through the filling hole (14) into the casting chamber (11); and Evacuating a gas contained within the casting chamber (11) via the vent hole (16) and the outflow channel (03) of the venting device (01); and Conveying the melt via the discharge hole (15) of the casting chamber (11) into a pressure die casting tool (101).

14. The method according to claim 13, wherein the casting device (10) comprises an inspection for determining the degree of saturation of the filter unit (06) of the venting device (01).

15. The method according to claim 13, wherein the venting device (01) or the filter unit (06) is replaced depending on the degree of saturation of the filter unit (06).

* * * * *